United States Patent [19]

Wiebe

[11] 4,132,176

[45] Jan. 2, 1979

[54] HYDRAULICALLY DAMPENED RAILWAY TRUCK BOLSTER

[75] Inventor: Donald Wiebe, Sewickley, Pa.

[73] Assignee: A. Stucki Company, Pittsburgh, Pa.

[21] Appl. No.: 838,479

[22] Filed: Oct. 3, 1977

[51] Int. Cl.[2] ..... B61F 5/06; B61F 5/12; B61F 5/14; B61F 5/24

[52] U.S. Cl. ..... 105/197 DH; 105/199 CB

[58] Field of Search ..... 105/193, 197 D, 197 DB, 105/197 DH, 199 CB

[56] References Cited

U.S. PATENT DOCUMENTS

| | | | |
|---|---|---|---|
| 2,630,079 | 3/1953 | Cottrell | 105/193 X |
| 2,642,008 | 6/1953 | Settles et al. | 105/197 DH |
| 2,782,731 | 2/1957 | Blattner | 105/197 D X |
| 2,996,019 | 8/1961 | Nelson | 105/197 DB |
| 3,005,629 | 10/1961 | Williams | 105/197 DH X |
| 3,104,622 | 9/1963 | Van Zijp et al. | 105/199 R |
| 3,121,402 | 2/1964 | Julien | 105/199 F X |
| 3,868,912 | 3/1975 | Wagner et al. | 105/197 DH |
| 3,957,318 | 5/1976 | Wiebe | 105/199 CB X |
| 4,004,525 | 1/1977 | Wiebe et al. | 105/197 DH |
| 4,080,016 | 3/1978 | Weibe | 105/199 CB |

*Primary Examiner*—Francis S. Husar
*Assistant Examiner*—Howard Beltran
*Attorney, Agent, or Firm*—Howard E. Sandler

[57] ABSTRACT

An apparatus for railway freight car control including a damping device adapted to be interposed between a bolster end and side frame member in a manner that the longitudinal axis thereof is inclined inwardly towards the swing axis of the side frame thus providing for a combined control effect for hunting and swaying.

3 Claims, 3 Drawing Figures

HYDRAULICALLY DAMPENED RAILWAY TRUCK BOLSTER

As is known, in the normal travel of railway cars over a railbed, various differences in the vertical profile of the laterally spaced trucks resulting from such causes as staggered rail joints and superelevation of the outside track on curves gives rise to a tendency of lateral rocking or swaying of the car body. In modern cars with heavy load capacity and a relatively high center of gravity the forces resulting from the weight shift of the car become so large at times that a variety of effects may develop such as:

(1) Complete unloading of the wheels on one side of the truck to the extent of lifting the unloaded wheels off the rail with a high potential of derailments;

(2) The imposition of extreme stresses on the car body and truck members; and (3) Cumulative damage and misalignment of track, ties and roadbeds through pounding action.

In addition to the above-mentioned problem of swaying, the operation of modern three-piece railway freight trucks presents a further problem of hunting. Hunting in railway vehicles is the unstable cyclic yawing of trucks and the resulting lateral oscillation of the railway car vehicle and is of particular significance when the car is traveling in an empty condition at relatively high speeds; for example, in excess of 40 miles per hour. The lateral track irregularities combined with conventional coned wheel configurations results in one side of a wheel set moving ahead of the other which in turn results in the flanges of the wheels striking and rubbing against the rails first on one side and then on the other thereby causing undesirable lateral body oscillating and excessive truck component and rail wear. As the wheel treads and flanges wear, the tread conicity becomes more severe and the flange-rail clearance becomes larger thereby resulting in even greater excursions of the wheel sets during hunting and hence a more severe response occurs at an even lower speed. The lateral excursions can become effectively severe to possibly result in derailments.

In addition to resonant swaying and hunting, an additional deleterious response on moving freight cars is a result of lateral track variation which for the most part produces nonresonance lateral effects such as those caused by shock resulting from sudden joint set offs and other miscellaneous track misalignment.

All of the above problems of railway vehicle operation have been recognized and to a certain extent alleviated by independent means. Specifically, U.S. Pat. Nos. 4,004,525 and 3,868,912 are drawn to a highly successful arrangement of a hydraulic snubber vertically disposed in a spring group to alleviate swaying. Furthermore, U.S. patent application Ser. No. 732,021, filed Oct. 31, 1976, U.S. now Pat. No. 4,080,016, issued Mar. 21, 1978, and assigned to the same assignee as is this invention is drawn to a unique elastomeric side bearing arrangement which controls hunting through friction between the truck and the car body. Still further, rigid truck configurations and high column guide friction between the bolster and side frame, combine to provide a limited improvement in car body hunting response control.

While all of the above devices have proved somewhat successful in controlling swaying and hunting, and to a lesser extent absorbing or controlling response from random lateral truck variation, it was not until applicant's invention that a single assembly in a specified location was conceived which is effective to independently alleviate all of these operational problems.

Specifically, applicant's invention includes a snubber or damping device interposed between a bolster end and side frame member in a manner that the longitudinal axis thereof is inclined inwardly towards the swing axis of the side frame thus providing for a combined control effect for hunting and swaying as well as a damping means for random lateral forces. With such an arrangement, the vertical component of the damper absorbs the motion, swaying, or rocking response or forces and the horizontal component dampens or absorbs the swaying or lateral motion response caused by hunting and also random lateral track variations. The operation of the present invention on swaying or rocking is exactly the same as discussed in the above-mentioned U.S. Pat. Nos. 4,004,525 and 3,868,912; however, although the result is the same, the operation of the instant invention with respect to hunting is different from that described in U.S. Pat. No. 3,957,318. Specifically, in the instant invention the transverse forces caused by hunting are dampened whereas in U.S. Pat. No. 3,957,318, the elastomeric side bearings act to control the hunting by frictional resistance.

These and other objects and advantages will become more readily apparent from a reading of the following description and drawings in which.

Figure 1:
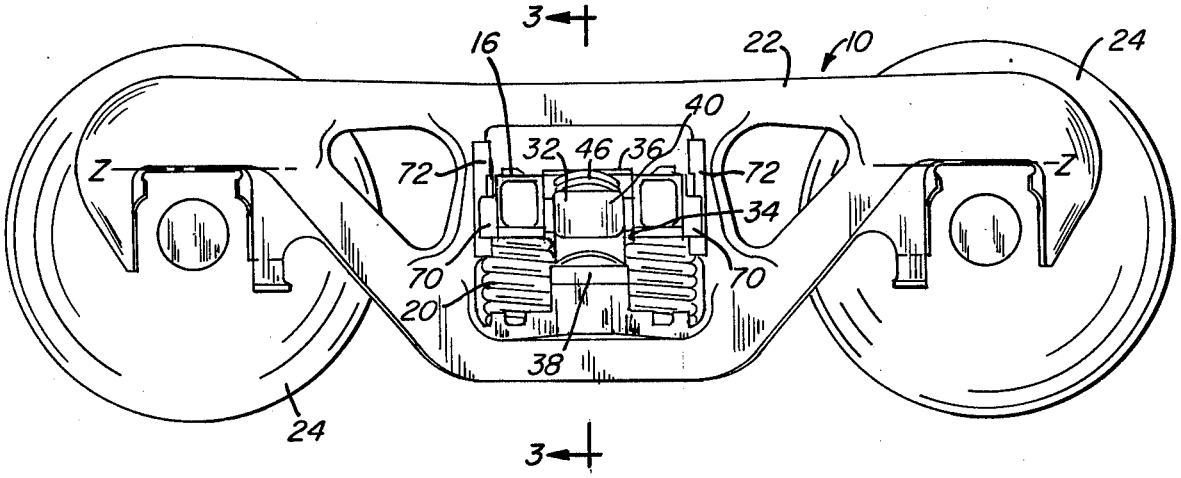
FIG. 1 is a schematic side elevational view of a freight car incorporating the present invention.
Figure 2:
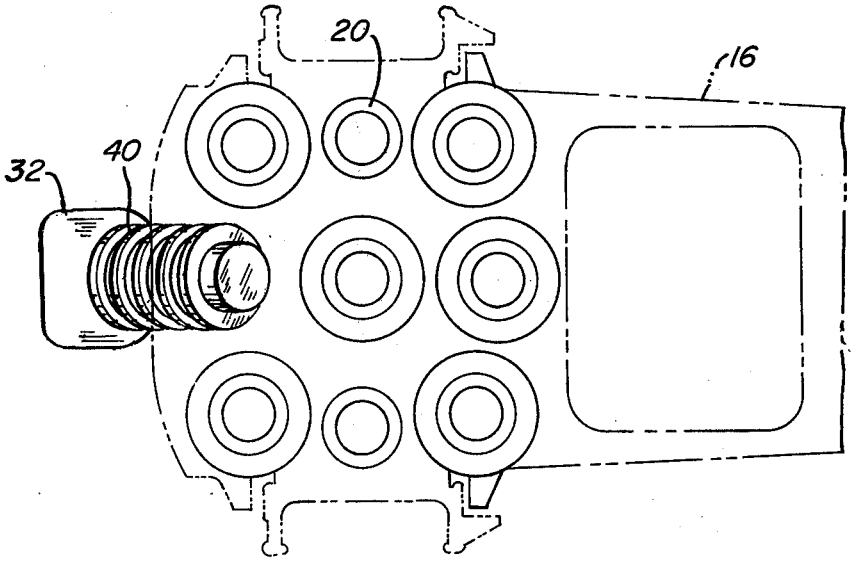
FIG. 2 is an enlarged partial cross-sectional view taken on lines 2—2 of FIG. 1 and more particularly illustrating the damping arrangement of the present invention.
Figure 3:
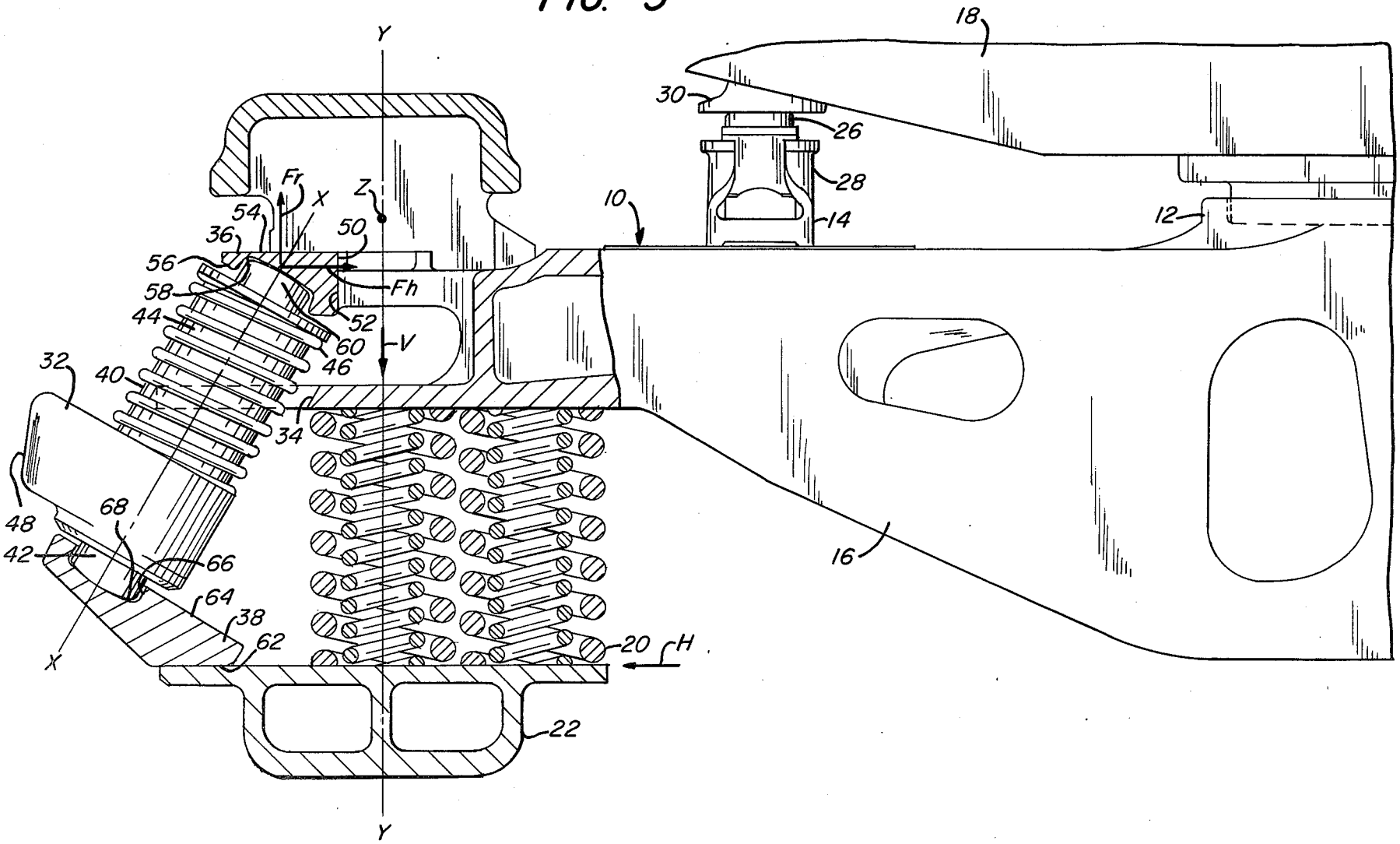
FIG. 3 is a schematic partial plan view further illustrating the damping arrangement of the present invention.

FIGS. 1–3 illustrate a fragmentary portion of a four wheel railway freight truck, generally illustrated at 10, which comprises: a centerplate 12 and suitable side bearings 14 (only one being shown) cooperating with a bolster 16 to support the car body 18; and spring groups 20 mounted on side frame 22 (only one being shown) to support the bolster 16. Suitably journaled wheels 24 support each side frame 22.

As shown, side bearings 14 are of a construction generally illustrated in U.S. Pat. No. 3,957,318 and include an elastomeric bearing block 26 disposed in a cage 28. As is fully described in the aforementioned U.S. Pat. No. 3,957,318, bearing blocks 26 engage the wear plates 30 of the car body 18 to aid in the control of hunting or oscillating in a horizontal plane. This hunting control is effected by frictional engagement between bearing blocks 26 and wear plates 30. It is to be noted at this time that the utilization of side bearings 14 such as illustrated in FIG. 2 is merely a preferred embodiment to be incorporated with the inclined snubber or damper assembly 32 (as described hereinafter) to achieve operational advantages of the method and apparatus of the present invention and that other side bearing arrangements may be utilized; for example, the arrangement described and illustrated in copending U.S. patent application Ser. No. 731,021. If it were preferred that hunting control be through the utilization of inclined damper assemblies 32 only, then a standard roller side bearing in a cage, with no elastomeric controlling blocks, may be substituted for the above-described side bearings 14.

An elongated inwardly inclined hydraulic damper assembly 32 is disposed within each spring group 20 on the outboard side thereof intermediate the bolster 16 and the respectively adjacent side frame 22. The bolster 16 is of a conventional design with the exception that an opening 34 has been formed in each end portion of the bolster 16 to provide a space for mounting a snubber assembly 32 of the present invention. As illustrated, opening 34 is formed in the lower flange of bolster 16 as an outwardly open generally rectangular configuration. Bolster 16 additionally includes an upper snubber seating member 36 positioned on the upper flange of bolster 16 at a position in substantial vertical alignment with opening 34. As will be described in detail hereinafter, member 36 is structured to seat and rotatably retain the upper end portion of the damper assembly 32.

Side frame 22 is likewise of a conventional construction with the exception that a lower damper seating member 38 is positioned at the outboard side thereof and extends outwardly therefrom. Also as will be described in detail hereinafter, member 38 is structured to seat and rotatably retain the lower end portion of the damper assembly 32.

Snubber or damper assembly 32 may be of any suitable construction and as illustrated is of the general structural and operational features of the snubber illustrated and described in FIGS. 1 and 2 of U.S. Pat. No. 3,995,720. As shown, damper assembly 32 comprises a generally hollow cylindrical body member 40 having a damper bottom member 42 carried thereby adjacent the lower end thereof. A suitable piston member 44 is axially reciprocable within body member 40. Suitable hydraulic fluid is received within body member 40. The flow of such hydraulic fluid in response to the axial movement of the piston member 42 and in conjunction with internal chambers, a piston head carried by the piston member 42 internally of the body member 40 and various valves and ports within body member 40, (the chambers, piston head, valves and ports, not shown), all cooperate in the usual manner to provide a means for damping by the damper assembly 32. Damper assembly 32 additionally includes a suitable biasing means which is operable to bias the piston member 44 away from the body member 40. As illustrated, this biasing means comprises a spring 46 coaxially received about the outer portion of piston member 44 intermediate the outer portion of piston member 44 intermediate the upper end thereof and an intermediate enlarged reservoir portion 48 of body member 40. Inasmuch as the particular internal configuration of damper assembly 32 as well as the specific operational characteristics thereof are not particularly germane to the invention herein and further that general structural and operating characteristics of hydraulic dampers or snubbers are well known to those skilled in the art, a further description thereof is not deemed necessary. The reader is referred to U.S. Pat. No. 3,995,720 for detailed description of one form of an acceptable damper.

Damper assemblies 32 are capitively retained in operational position by means of upper and lower seating members 36 and 38 respectively. Upper seating member 36 is formed of a generally rectangular cross section having the shorter leg 50 thereof abutting the outermost surface 52 of an inwardly depressed central outboard portion of bolster 16. The longer leg 54 of seating member 36 lies in a plane generally common with the major extent of the uppermost flange of bolster 16. The hypotenuse 56 of seating member 36 extends diagonally upwardly from the lowermost extent of legs 50 and faces generally downwardly. A downwardly open concave partially cylindrical seating depression 58 is formed within hypotenuse 56. In assembled position, as described hereinafter, depression 58 is cooperable with the uppermost convex cylindrical portion 60 of piston member 44 to captively seat the upper portion of damper assembly 32 in a center seeking manner.

Lower seating member 38 is of a generally rectangular configuration having the inner side 62 thereof formed with or suitably affixed to the outboard side of the uppermost surface of the lower flange of side frame 22. Seating member 38 extends diagonally upwardly from inner side 62 in a manner that the uppermost surface 64 thereof is generally parallel to the hypotenuse 56 of the upper seating member 36. An upwardly open concave partially cylindrical seating depression 66 is formed within uppermost surface 64. In assembled position, as described hereinafter, depression 66 is cooperable with the lowermost convex cylindrical portion 68 of bottom member 42 to captively seat the lower portion of the damper assembly 32 in a center seeking manner.

The center-seeking concave-convex pairs of mating bearing portions (i.e., depression 58 with convex portion 60 and depression 66 with convex portion 68) is advantageous to prevent edge contacts with high unit bearing stresses. For further description of the advantages of convex-concave mating relationship as well as specific structural relationships of the particular radii relationship, reference is hereby made to U.S. Pat. No. 3,595,350, which issued to the inventor of the instant invention and is assigned to the same assignee as is this invention.

Depressions 66 are spaced downwardly and outwardly from depressions 58 and a line X—X drawn between the respective centers of the depressions is inclined inwardly towards the vertical equilibrium axis Y—Y of each side frame 22. As shown the inward inclination is at an angle of approximately 30° with respect to a vertical; however, it is contemplated that an inward inclination in the range of 20° to 45° would be acceptable for the purposes of this invention so long as clearance problems are met. Furthermore, preferably the inward angle of inclination should be such that a line through X—X will intersect the respective vertical side frame equilibrium axis Y—Y at a location substantially no higher than the uppermost surface of the side frame 22. The rationale for this latter preference will be explained more fully hereinafter. It is to be further noted that the particular arrangement of damper assembly 32 as illustrated in FIG. 2 is in the fully extended position as it would appear with an empty freight car. When the freight car is loaded the angle of inclination as represented by line X—X would increase from the vertical and would intersect the axis Y—Y closer to the swing axis of the side frame 22. The side frame swing axis is generally represented by the letter "Z" in FIG. 3 and axis "Z" in FIG. 1 and as shown extends on a normal through axis Y—Y.

A damper assembly 32 is operationally received within each spring group 20 in a manner that portion 68 of bottom member 42 is seated within a respective seating depression 66 and portion 60 of piston 44 is seated within a respective seating depression 56. Further the outer spring 46 which acts on both the body member 40 and the piston member 42 tends to bias these members into firm engagement with the respective seating members 38 and 36 thereby better ensuring the captive and frictional retention of damper assembly 32 between seating members 36 and 38.

Thus it can be seen that with damper assembly 32 operationally positioned as described hereinabove, the axis of elongation and of reciprocation of assembly 32 extends substantially along the line of inclination X—X. Accordingly, for all purposes herein it will be deemed that the line X—X also represents the axis of elongation and of reciprocation of assembly 32 and the discussion hereinbefore with respect to the angle of inward inclination of X—X, with respect to a vertical, is equally germane to assembly 32. With damper assemblies 32 positioned and inclined inwardly, each damper assembly 32 will simultaneously apply both vertical and horizontal damping forces generally indicated at $F_v$ and $F_h$, respectively. Furthermore, lateral bolster motion in the direction "V," as indicated in FIG. 3, results in lateral deflection of springs 20 that will swing the bottom of the side frame 22 outwardly, pivoting about axis Z—Z. As a result both rotation of side frame 22 and lateral translation thereof with respect to bolster 16 causes shortening of the damper assembly 32 and a compression force along axis X—X. Thus damper forces at the side frame 22 are counter rotative to the lateral spring forces, stabilizing the pendulous motion of the side frame 22 that may result from either lateral rocking or hunting resonance.

When a railway freight truck 10 supporting a car body 18 is traveling over track the normal tilting or swaying of the car body 18 is readily arrested by the side bearings with perhaps slight compression of the spring groups 20 supporting that end of the bolster 16 toward which the body is swaying. Due to yielding of the spring groups 20, the car body 18 rebounds from the extreme tilted position and under certain conditions will swing over to tilt in the opposite direction and strike the side bearings 14 on the other side of the truck 10 to produce a series of oscillations between the extreme positions of the car body 18. In many instances the energy of the first tilting motion is absorbed in the internal and external friction of the various members involved, but when a car body 18 is traveling along a track the energy of the first impulse provided by the rising of a pair of wheels 24 on one side of the track 10 will initiate a rocking motion to the car body 18 and such rocking motion may be augmented by a second impulse produced by the opposite pair of wheels 24 passing over a high portion of track at or near the time of rebound of the first oscillation. Inasmuch as such augmentation may well be more violent than the first. In extreme cases, this effect may become so large at times as to cause extreme and dangerous rocking of the body 18 with resulting deleterious effects such as potential of derailment, imposition of extreme stresses on the car body and truck members and cumulative damage and misalignment of track, ties and roadbeds through pounding actions. It is specifically to these effects, which are transmitted to the spring groups 20 as a vertical force, that the damping force $F_v$ is directed.

The transverse or horizontal damping force $F_h$ is directed primarily to two classes of response conditions: (1) response which normally occur during operation of a freight truck 10 in an unloaded condition; and (2) response which normally occur during operation of a freight truck 10 in a loaded condition.

During operation of modern empty three-piece railway freight trucks hunting may occur. Hunting in railway vehicles is the unstable cyclical yawing of trucks and the resulting lateral oscillation of the car body on the trucks and is of particular significance when the truck, such as truck 10, is traveling in an empty condition at relatively high speeds; for example, in excess of 40 miles per hour. Hunting may also considered as a resulting response to the wheel set oscillations with respect to the car body 10. Experience has shown that most severe hunting responses occur at 1.5 to 4 cycles per second. As a specific example, in a new coned wheel the tread slopes of 1 on 20 on a typical 33 inch mean diameter wheel will result in a harmonic lateral motion path of the wheel set, limited in amplitude by the flange to rail gage clearance ($\frac{1}{4}$ inch to 1 inch), that repeats at 52 feet intervals if there is no slippage between the wheels and the rail. If the suspension encourages a car body to truck or side frame lateral resonance of 1.5 cycles per second, so called primary or car body hunting could begin at 53 mph. Primary or car body hunting begins at a speed corresponding to the lowest available frequency, car body to truck lateral response resonance. This resonance may include any combination of not only rigid car body motion modes on the springs, lateral yaw and roll, but also car body distortional modes such as bending and twisting. At the onset of car body to truck resonance, the so called threshold hunting speed increases, the springs deflect laterally to the bolster gib stops and swing the side frame about the motion center "Z" and the wheel sets slide laterally to the respective flange limits thereof. The wheel set path is thus determined or actually driven by the car body to truck resonance and is no longer a path of the non-sliding wheel conic geometry. It is specifically to this problem in higher speed operation of unloaded trucks that $F_h$ is directed. $F_h$ provides a resisting damping force to effect the bolster to side frame motion from the hunting response thereby better ensuring that resonant conditions do not occur. In this instance, $F_h$ is curative of the effect but not the cause.

Insofar as controlling the cause of hunting, applicant makes reference to his U.S. Pat. No. 3,957,318, which is assigned to the same assignee as is this invention. This patent discloses side bearings utilizing constrained elastomeric bearing blocks to control hunting. In the preferred embodiment herein it is contemplated using side bearings 14 of the type illustrated in U.S. Pat. No. 3,957,318 as well as the inclined damper assembly 32 of the present invention. With such a structural arrangement means are now provided to reduce the cause of hunting with the side bearings 14 while simultaneously having an independent system to reduce the effect of hunting, inclined damper assembly 32. If desired, standard side bearings without elastomeric bearing blocks 26 could be substituted for side bearings 14; however, it would be preferable in many instances to have both of the systems operating independently to better insure control and/or damping of hunting within acceptable parameters. Furthermore, by having a means such as inclined damper assembly 32 to dampen hunting within acceptable limits, the friction of the bearing blocks 36 which inhibits truck swivel may be reduced from that specified in the aforementioned U.S. Pat. No. 3,957,318.

$F_h$ also resists the lateral force resulting from rocking which may occur when the truck 10 is loaded and bolster 16 is lower with respect to the side frame 22. In this instance it is also desirable that the line X—X be somewhat near the swing axis Z. If X—X does not in fact intersect Y—Y or intersects Y—Y at a point upwardly of the uppermost surface of side frame 22, the side frame 22 will have a tendency to rotate due to the damper forces. In instances of a loaded car in the rocking mode it is desirable to minimize side frame rotation. Lateral forces due to rocking would tend to move the bolster gibs 70 into contact with the pededstal column 72. The damper force $F_h$ will tend to resist this movement and most certainly dampen its effects. It is necessary to permit lateral motion of the car body 18 with respect to the wheel set. If the car body 18 were laterally fixed to the truck, any minor change in direction of the wheel set would carry the car body with it and cause severe lateral acceleration. Friction groups alone are generally inadequate to control lateral forces due to rocking. With friction only, the bolster freedom is rather inexact and in sporadic lateral excursions the bolster abruptly impacts the pedestal column 72. The damper force $F_h$ will cushion or largely absorb this impact.

The invention described hereinabove relates primarily to an inwardly inclined damper assembly 32 having the capability of damping vertical motion and horizontal motion resulting from freight car response to hunting and rocking. The invention additionally relates to simultaneously damping these forces from a single given location as well as the utilization of two independent systems for the control of the effect of hunting. Accordingly, various modifications may be made to the preferred embodiment discussed hereinbefore without departing from the scope of the invention which is defined by the claims set forth hereinafter, for example: alternative configurations to seating members 36 and 38 are contemplated; a differing configuration damper assembly 32 may be used, such as a reverse arrangement; the damper assembly 32 need not necessarily have a reservoir portion 32; more positive snubber retaining means may be included; a double acting damper assembly may be utilized rather than the single acting damper assembly 32 illustrated; and the like.

What is claimed is:

1. In a railway vehicle truck assembly in which a laterally extending bolster member extends between a transversely spaced pair of side frame members and is supported thereby adjacent respective axial end portions thereof by respective spring groups seated on said side frame members, the improvement comprising: elongated longitudinally telescopic hydraulic damping means interposed in each of said spring groups adjacent the outboard side thereof; the longitudinal axis of each of said damping means being inclined inwardly toward the swing axis of the respective side frame adjacent thereto in a manner that the lower end of each of said damping means is operably carried at an outboard location of a respective side frame member and the upper end of each of said damping means is operably positioned in communication with said bolster member at a location spaced inwardly from said lower end; and further that during normal operation of such a rail vehicle truck, said longitudinal axis intersects the vertical axis of symmetry of said respective side frame at a location at least upwardly adjacent said swing axis of said respective side frame; and said damping means being operable to dampen both horizontal and vertical forces applied thereto through said members.

2. A railway vehicle truck assembly as specified in claim 1 wherein each of said damping means are simultaneously biased into engagement with said bolster member and said side frame member adjacent thereto.

3. A railway vehicle truck assembly as specified in claim 1 wherein said bolster member includes a center plate supporting a car body thereupon and additionally including elastomeric side bearing means disposed intermediate said bolster member and said car body member on opposite longitudinal sides of said center plate and said side bearing means are operative to inhibit hunting of such a railway vehicle truck assembly.

* * * * *